US009290912B2

(12) United States Patent
Wen et al.

(10) Patent No.: US 9,290,912 B2
(45) Date of Patent: Mar. 22, 2016

(54) ENERGY RECOVERY SYSTEM HAVING INTEGRATED BOOM/SWING CIRCUITS

(71) Applicant: Caterpillar Inc., Peoria, IL (US)

(72) Inventors: Gang Victor Wen, Dunlap, IL (US); Pengfei Ma, Naperville, IL (US); Jiao Zhang, Naperville, IL (US); Tonglin Shang, Bolingbrook, IL (US)

(73) Assignee: Caterpillar Inc., Peoria, IL (US)

( * ) Notice: Subject to any disclaimer, the term of this patent is extended or adjusted under 35 U.S.C. 154(b) by 704 days.

(21) Appl. No.: 13/665,384

(22) Filed: Oct. 31, 2012

(65) Prior Publication Data

US 2014/0119867 A1 May 1, 2014

(51) Int. Cl.

| | |
|---|---|
| ***F16D 31/02*** | (2006.01) |
| ***E02F 9/22*** | (2006.01) |
| ***F15B 1/027*** | (2006.01) |
| ***F15B 11/17*** | (2006.01) |

(Continued)

(52) U.S. Cl.

CPC ..... *E02F 9/2296* (2013.01); *E02F 9/123* (2013.01); *E02F 9/2217* (2013.01); *E02F 9/2242* (2013.01); *E02F 9/2292* (2013.01); *F15B 1/027* (2013.01); *F15B 1/0275* (2013.01); *F15B 11/17* (2013.01); *F15B 13/06* (2013.01); *F15B 21/14* (2013.01); *F15B 2211/20576* (2013.01); *F15B 2211/212* (2013.01); *F15B 2211/6306* (2013.01); *F15B 2211/6313* (2013.01); *F15B 2211/7058* (2013.01); *F15B 2211/7135* (2013.01)

(58) Field of Classification Search

CPC ..... F15B 1/027; F15B 1/033; F15B 11/17; F15B 13/06; F15B 21/14; E02F 9/123; E02F 9/2217

USPC ..... 60/413, 414, 421, 422

See application file for complete search history.

(56) References Cited

U.S. PATENT DOCUMENTS

| | | | |
|---|---|---|---|
| 4,369,625 | A | 1/1983 | Izumi et al. |
| 4,449,366 | A | 5/1984 | Sato et al. |

(Continued)

FOREIGN PATENT DOCUMENTS

| | | |
|---|---|---|
| CN | 102912821 | 12/2014 |
| EP | 1 598 561 | 11/2005 |

(Continued)

OTHER PUBLICATIONS

Wang et al., Longke; "Application of Singular Perturbation Theory to Hydraulic Pump Controlled Systems," Fellow, IEEE (2010).

(Continued)

*Primary Examiner* — Michael Leslie

(57) ABSTRACT

An energy recovery system for a machine is disclosed. The energy recovery system may have a boom circuit with at least a one linear actuator configured to move a work tool, and a boom accumulator configured to selectively collect pressurized fluid from the at least one linear actuator and to discharge pressurized fluid back to the at least one linear actuator. The energy recovery system may also have a swing circuit with a swing motor configured to move the work tool, and a swing accumulator configured to selectively collect pressurized fluid from the swing motor and discharge pressurized fluid back to the swing motor. The energy recovery system may further have a common accumulator passage fluidly connecting the boom accumulator and the swing accumulator.

19 Claims, 4 Drawing Sheets

(51) Int. Cl.

| | |
|---|---|
| ***F15B 13/06*** | (2006.01) |
| ***F15B 21/14*** | (2006.01) |
| ***E02F 9/12*** | (2006.01) |

(56) References Cited

U.S. PATENT DOCUMENTS

| | | | |
|---|---|---|---|
| 4,561,249 | A | 12/1985 | Watanabe et al. |
| 4,586,330 | A | 5/1986 | Watanabe et al. |
| 4,768,339 | A | 9/1988 | Aoyagi et al. |
| 4,833,798 | A | 5/1989 | Ehrich |
| 5,048,293 | A | 9/1991 | Aoyagi |
| 5,329,767 | A | 7/1994 | Hewett |
| 5,630,316 | A | 5/1997 | Itsuji et al. |
| 6,009,708 | A | 1/2000 | Miki et al. |
| 6,151,894 | A | 11/2000 | Endo et al. |
| 6,330,797 | B1 | 12/2001 | Kondo |
| 6,378,301 | B2 | 4/2002 | Endo et al. |
| 6,408,549 | B1 | 6/2002 | Quenzi et al. |
| 6,434,864 | B1 | 8/2002 | Epshteyn |
| 6,584,769 | B1 | 7/2003 | Bruun |
| 6,634,653 | B2 | 10/2003 | Chatterjea |
| 6,691,603 | B2 | 2/2004 | Linerode et al. |
| 6,745,992 | B2 | 6/2004 | Yang et al. |
| 6,789,335 | B1 | 9/2004 | Kinugawa et al. |
| 6,789,387 | B2 | 9/2004 | Brinkman |
| 6,918,247 | B1 | 7/2005 | Warner |
| 7,121,189 | B2 | 10/2006 | Vonderwell et al. |
| 7,191,846 | B2 | 3/2007 | Matsumoto et al. |
| 7,243,591 | B2 | 7/2007 | Dixen et al. |
| 7,260,931 | B2 | 8/2007 | Egelja et al. |
| 7,269,944 | B2 | 9/2007 | Zhang et al. |
| 7,272,928 | B2 | 9/2007 | Ariga et al. |
| 7,412,827 | B2 | 8/2008 | Verkuilen |
| 7,434,391 | B2 | 10/2008 | Asam et al. |
| 7,487,707 | B2 | 2/2009 | Pfaff et al. |
| 7,490,421 | B1 | 2/2009 | Pletzer et al. |
| 7,516,613 | B2 | 4/2009 | Kadlicko |
| 7,516,614 | B2 | 4/2009 | Bitter |
| 7,596,893 | B2 | 10/2009 | Tozawa et al. |
| 7,634,911 | B2 | 12/2009 | Brinkman |
| 7,712,309 | B2 | 5/2010 | Vigholm |
| 7,823,379 | B2 | 11/2010 | Hamkins et al. |
| 7,905,088 | B2 | 3/2011 | Stephenson et al. |
| 7,908,852 | B2 | 3/2011 | Zhang et al. |
| 8,209,975 | B2 | 7/2012 | Persson et al. |
| 8,726,645 | B2 * | 5/2014 | Shang et al. ..... 60/414 |
| 8,776,511 | B2 | 7/2014 | Zhang et al. |
| 8,850,806 | B2 | 10/2014 | Zhang et al. |
| 8,863,509 | B2 | 10/2014 | Opdenbosch et al. |
| 8,893,490 | B2 | 11/2014 | Knussman et al. |
| 8,910,474 | B2 | 12/2014 | Knussman et al. |
| 8,919,113 | B2 | 12/2014 | Ma et al. |
| 8,919,114 | B2 | 12/2014 | Edler et al. |
| 8,943,819 | B2 | 2/2015 | Knussman et al. |
| 8,944,103 | B2 | 2/2015 | Opdenbosch et al. |
| 8,966,891 | B2 | 3/2015 | Opdenbosch et al. |
| 8,966,892 | B2 | 3/2015 | Opdenbosch et al. |
| 8,973,358 | B2 | 3/2015 | Kuehn et al. |
| 8,978,373 | B2 | 3/2015 | Opdenbosch et al. |
| 8,978,374 | B2 | 3/2015 | Opdenbosch et al. |
| 8,984,873 | B2 | 3/2015 | Opdenbosch et al. |
| 9,051,714 | B2 | 6/2015 | Opdenbosch et al. |
| 9,057,389 | B2 | 6/2015 | Opdenbosch et al. |
| 9,068,575 | B2 | 6/2015 | Zhang et al. |
| 9,068,578 | B2 | 6/2015 | Opdenbosch et al. |
| 9,080,310 | B2 | 7/2015 | Knussman |
| 9,139,982 | B2 | 9/2015 | Ma et al. |
| 9,151,018 | B2 | 10/2015 | Knussman |
| 2004/0083629 | A1 | 5/2004 | Kondou |
| 2004/0118623 | A1 | 6/2004 | Shore et al. |
| 2004/0123499 | A1 | 7/2004 | Arii |
| 2005/0012337 | A1 | 1/2005 | Yoshimatsu |
| 2005/0036894 | A1 | 2/2005 | Oguri |
| 2005/0196288 | A1 | 9/2005 | Cherney |
| 2007/0044463 | A1 | 3/2007 | VerKuilen et al. |
| 2007/0068049 | A1 | 3/2007 | Quenzi et al. |
| 2007/0295005 | A1 | 12/2007 | Fleischmann |
| 2008/0104955 | A1 | 5/2008 | Khalil |
| 2008/0155975 | A1 | 7/2008 | Brinkman |
| 2008/0250783 | A1 | 10/2008 | Griswold |
| 2008/0300757 | A1 | 12/2008 | Kanayama et al. |
| 2008/0314038 | A1 | 12/2008 | Tozawa et al. |
| 2008/0314607 | A1 | 12/2008 | May |
| 2009/0000290 | A1 | 1/2009 | Brinkman |
| 2009/0077837 | A1 | 3/2009 | Tozawa et al. |
| 2009/0165450 | A1 | 7/2009 | Cherney et al. |
| 2009/0217653 | A1 | 9/2009 | Zhang et al. |
| 2009/0288408 | A1 | 11/2009 | Tozawa et al. |
| 2010/0000209 | A1 | 1/2010 | Wada et al. |
| 2010/0000211 | A1 | 1/2010 | Ikeda et al. |
| 2010/0043420 | A1 | 2/2010 | Ikeda et al. |
| 2010/0089049 | A1 | 4/2010 | Matsuura et al. |
| 2010/0107620 | A1 | 5/2010 | Nelson et al. |
| 2010/0115936 | A1 | 5/2010 | Williamson et al. |
| 2010/0162593 | A1 | 7/2010 | Hughes, IV et al. |
| 2010/0162885 | A1 | 7/2010 | Hughes, IV et al. |
| 2010/0163258 | A1 | 7/2010 | Hughes, IV et al. |
| 2010/0218493 | A1 | 9/2010 | Nakamura et al. |
| 2010/0236232 | A1 | 9/2010 | Boehm et al. |
| 2011/0029206 | A1 | 2/2011 | Kang et al. |
| 2011/0030364 | A1 | 2/2011 | Persson et al. |
| 2011/0302914 | A1 | 12/2011 | Helbling |
| 2012/0067432 | A1 | 3/2012 | Vigholm et al. |
| 2013/0081382 | A1 | 4/2013 | Nelson et al. |
| 2013/0098011 | A1 | 4/2013 | Knussman |
| 2013/0098013 | A1 | 4/2013 | Edler et al. |
| 2013/0098459 | A1 | 4/2013 | Opdenbosch |
| 2013/0098463 | A1 | 4/2013 | Kuehn et al. |
| 2014/0033689 | A1 | 2/2014 | Opdenbosch |
| 2014/0033697 | A1 | 2/2014 | Opdenbosch |
| 2014/0119868 | A1 | 5/2014 | Wen et al. |
| 2014/0123633 | A1 | 5/2014 | Rosth |

FOREIGN PATENT DOCUMENTS

| | | |
|---|---|---|
| GB | 2 269 425 | 2/1994 |
| JP | 56-016735 | 2/1981 |
| JP | 57-134007 | 8/1982 |
| JP | 58-044133 | 3/1983 |
| JP | 63-067403 | 3/1988 |
| JP | 02-108733 | 4/1990 |
| JP | 05-287774 | 11/1993 |
| JP | 06-057786 | 3/1994 |
| JP | 08-014201 A | 1/1996 |
| JP | 10-96402 | 4/1998 |
| JP | 10-103112 | 4/1998 |
| JP | 2004-125094 | 4/2004 |
| JP | 2005-003183 | 1/2005 |
| JP | 2005-155230 A | 6/2005 |
| JP | 2006-118685 | 5/2006 |
| JP | 2006-312995 | 11/2006 |
| JP | 2006-322578 | 11/2006 |
| JP | 2007-247701 | 9/2007 |
| JP | 2008-089023 | 4/2008 |
| JP | 2008128478 | 6/2008 |
| JP | 2010-084888 | 4/2010 |
| JP | 2011-069432 | 4/2011 |
| JP | 2011-179280 | 9/2011 |
| JP | 50-94097 | 12/2012 |
| KR | 100641388 | 10/2006 |
| KR | 1020060078300 | 7/2009 |
| KR | 1020100075340 | 7/2010 |
| WO | WO 2005/024246 | 3/2005 |
| WO | WO 2009/084853 | 7/2009 |
| WO | WO 2009/123047 | 10/2009 |
| WO | WO 2010/040890 | 4/2010 |
| WO | WO 2011/041410 | 4/2011 |
| WO | WO 2011/145947 | 11/2011 |
| WO | 2013081220 | 6/2013 |

(56) References Cited

FOREIGN PATENT DOCUMENTS

OTHER PUBLICATIONS

Williamson et al., Christopher, "Stability and Motion Control of Inertial Loads With Displacement Controlled Hydraulic Actuators," Purdue University (2010).

Linjama, M. (2011) entitled "Digital Fluid Power-State of the Art", The 12$^{th}$ Scandinavian International Conference on Fluid Power, May 18-20, 2011, Tampere, Finland.

Zimmerman, J. PhD Student/Purdue University, Center for Compact and Efficient Fluid Power PowerPoint Presentation, 2010 Annual Meeting (Jun. 14).

Zimmerman, J. et al., "Hybrid Displacement Controlled Multi-Actuator Hydraulic Systems", The Twelfth Scandinavian International Conference on Fluid Power , Tampere, Finland (May 18-20, 2011).

Brezonick, M., entitled "The Potential of Pump-Controlled Hydraulics", Hydraulic Horizons, Diesel Progress North American Edition (Jan. 2009).

Zick, J., entitled "Verbesserte Leistungsausnutzung bei Erdbaumaschinen durch optimal Pumpensteuerung", Olhydraulic und pneumatic 20 (1976) Nr. 4.

* cited by examiner

ENERGY RECOVERY SYSTEM HAVING INTEGRATED BOOM/SWING CIRCUITS

TECHNICAL FIELD

The present disclosure relates generally to an energy recovery system and, more particularly, to an energy recovery system having integrated boom/swing circuits.

BACKGROUND

Swing-type excavation machines, for example hydraulic excavators and front shovels, require significant hydraulic pressures and flows to transfer material from a dig location to a dump location. These machines direct high-pressure fluid from an engine-driven pump of a swing circuit through a swing motor to accelerate a loaded work tool at the start of each swing, and then restrict the flow of fluid exiting the swing motor at the end of each swing to slow and stop the work tool. Such machines also generally include a boom circuit with its own pump and actuators that together function to raise and lower the work tool simultaneous with or independent of the swinging motion.

One problem associated with this type of hydraulic arrangement involves efficiency. In particular, the fluid exiting the swing motor at the end of each swing and/or exiting the lift actuators during lowering of the work tool can be under a relatively high pressure due to the momentum and/or weight of the loaded work tool. Unless recovered, energy associated with the high-pressure fluid may be wasted. In addition, restriction of this high-pressure fluid during swing deceleration can result in heating of the fluid, which must be accommodated with an increased cooling capacity of the machine.

One attempt to improve the efficiency of a swing-type machine is disclosed in U.S. Pat. No. 7,905,088 of Stephenson et al. that issued on Mar. 15, 2011 (the '088 patent). In particular, the '088 patent discloses a energy recovery system having a boom circuit tied to a swing circuit by way of a shuttle valve, a pressure-actuated valve, and a control valve. During times when the swing rotation of the machine is coming to a stop, pressurized fluid from the swing circuit pushes through the shuttle valve and pressure-actuated valve to enter an accumulator of the boom circuit. This stored fluid can then either be used by the boom circuit to assist movement of boom cylinders, or alternatively directed back through a swing motor of the swing circuit via the control valve in place of or to supplement fluid flow from a swing pump.

Although the energy recovery system of the '088 patent may help to improve efficiencies of a swing-type machine in some situations through storage and re-use of pressurized fluid, it may still be less than optimal. In particular, there may be times when excess stored fluid exists, but neither the boom or swing circuits are in need of the fluid or the pressure of the excess fluid is unsuitable for capture or reuse. During this time, no additional energy capture can be accomplished and the associated energy may be wasted. In addition, the single accumulator of the '088 patent may need to be very large in order to capture all the available fluid from both circuits. The size of such an accumulator may make packaging difficult and increase a size and cost of the associated machine. Further, the number of operations available for re-using the captured energy may be limited in the energy recovery system of the '088 patent.

The disclosed energy recovery system is directed to overcoming one or more of the problems set forth above and/or other problems of the prior art.

SUMMARY

One aspect of the present disclosure is directed to an energy recovery system. The energy recovery system may include a boom circuit having at least a one linear actuator configured to move a work tool, and a boom accumulator configured to selectively collect pressurized fluid from the at least one linear actuator and to discharge pressurized fluid back to the at least one linear actuator. The energy recovery system may also include a swing circuit having a swing motor configured to move the work tool, and a swing accumulator configured to selectively collect pressurized fluid from the swing motor and discharge pressurized fluid back to the swing motor. The energy recovery system may further include a common accumulator passage fluidly connecting the boom accumulator and the swing accumulator.

Another aspect of the present disclosure is directed to a method of recovering energy. The method may include directing pressurized fluid into a linear actuator to move a work tool, and storing pressurized fluid from the linear actuator in a boom accumulator. The method may also include directing pressurized fluid into a swing motor to move the work tool, and storing pressurized fluid from the linear actuator in a swing accumulator. The method may additionally include selectively communicating the boom and swing accumulators.

DETAILED DESCRIPTION

Figure 1:
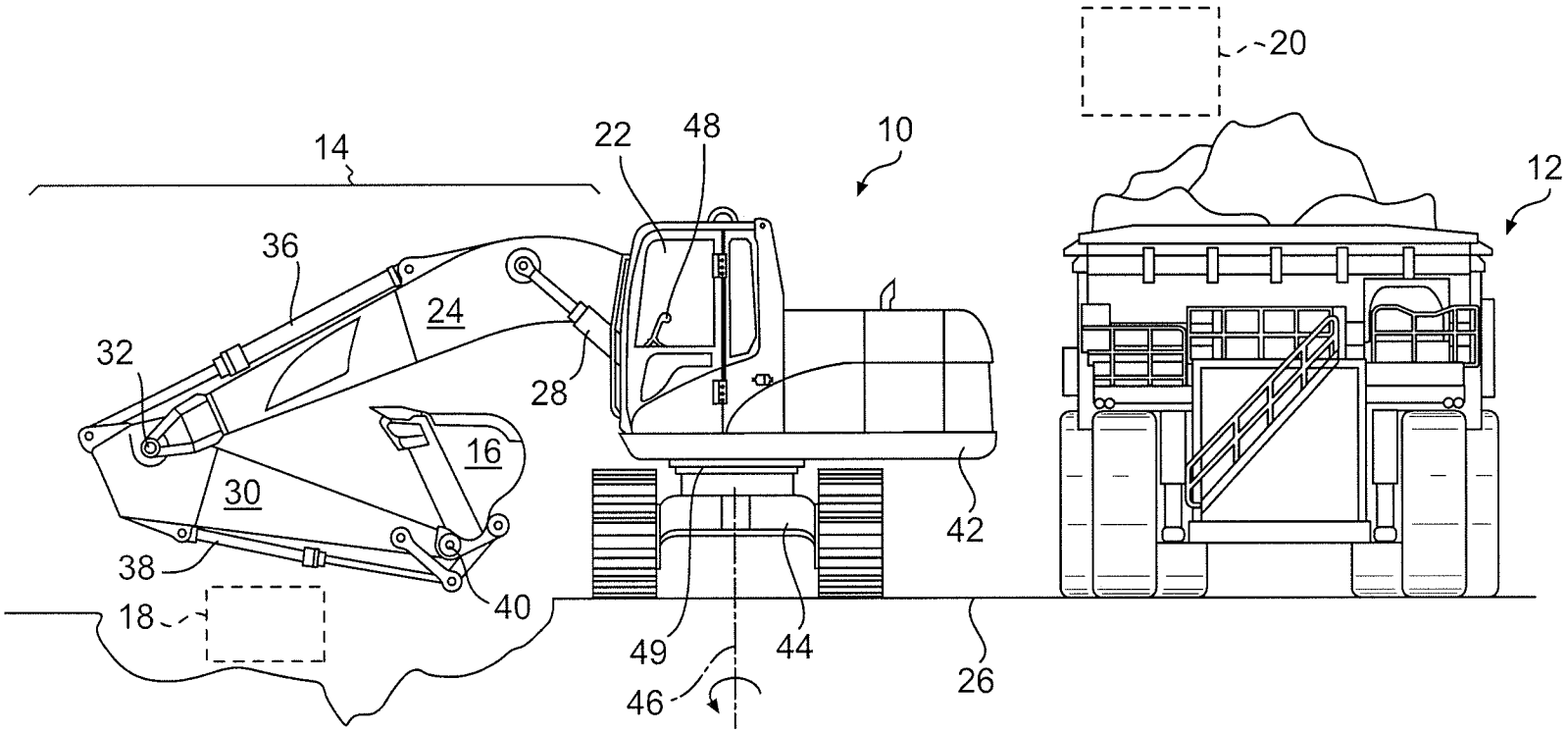
FIG. 1 is a diagrammatic illustration of an exemplary disclosed machine operating at a worksite with a haul vehicle.

FIG. 1 illustrates an exemplary machine 10 having multiple systems and components that cooperate to excavate and load earthen material onto a nearby haul vehicle 12. In the depicted example, machine 10 is a hydraulic excavator. It is contemplated, however, that machine 10 could alternatively embody another swing-type excavation or material handling machine, such as a backhoe, a front shovel, a dragline excavator, a crane, or another similar machine. Machine 10 may include, among other things, an implement system 14 configured to move a work tool 16 between a dig location 18 within a trench or at a pile, and a dump location 20, for example over haul vehicle 12. Machine 10 may also include an operator station 22 for manual control of implement system 14. It is contemplated that machine 10 may perform operations other than truck loading, if desired, such as craning, trenching, and material handling.

Implement system 14 may include a linkage structure acted on by fluid actuators to move work tool 16. Specifically, implement system 14 may include a boom 24 that is vertically pivotal relative to a work surface 26 by a pair of adjacent, double-acting, hydraulic cylinders 28 (only one shown in FIG. 1). Implement system 14 may also include a stick 30 that is vertically pivotal about a horizontal pivot axis 32 relative to boom 24 by a single, double-acting, hydraulic cylinder 36.

Implement system 14 may further include a single, double-acting, hydraulic cylinder 38 that is operatively connected to work tool 16 to tilt work tool 16 vertically about a horizontal pivot axis 40 relative to stick 30. Boom 24 may be pivotally connected to a frame 42 of machine 10, while frame 42 may be pivotally connected to an undercarriage member 44 and swung about a vertical axis 46 by a swing motor 49. Stick 30 may pivotally connect work tool 16 to boom 24 by way of pivot axes 32 and 40. It is contemplated that a greater or lesser number of fluid actuators may be included within implement system 14 and connected in a manner other than described above, if desired.

Numerous different work tools 16 may be attachable to a single machine 10 and controllable via operator station 22. Work tool 16 may include any device used to perform a particular task such as, for example, a bucket, a fork arrangement, a blade, a shovel, a crusher, a shear, a grapple, a grapple bucket, a magnet, or any other task-performing device known in the art. Although connected in the embodiment of FIG. 1 to lift, swing, and tilt relative to machine 10, work tool 16 may alternatively or additionally rotate, slide, extend, open and close, or move in another manner known in the art.

Operator station 22 may be configured to receive input from a machine operator indicative of a desired work tool movement. Specifically, operator station 22 may include one or more input devices 48 embodied, for example, as single or multi-axis joysticks located proximal an operator seat (not shown). Input devices 48 may be proportional-type controllers configured to position and/or orient work tool 16 by producing a work tool position signal that is indicative of a desired work tool speed and/or force in a particular direction. The position signal may be used to actuate any one or more of hydraulic cylinders 28, 36, 38 and/or swing motor 49. It is contemplated that different input devices may alternatively or additionally be included within operator station 22 such as, for example, wheels, knobs, push-pull devices, switches, pedals, and other operator input devices known in the art.

Figure 2:
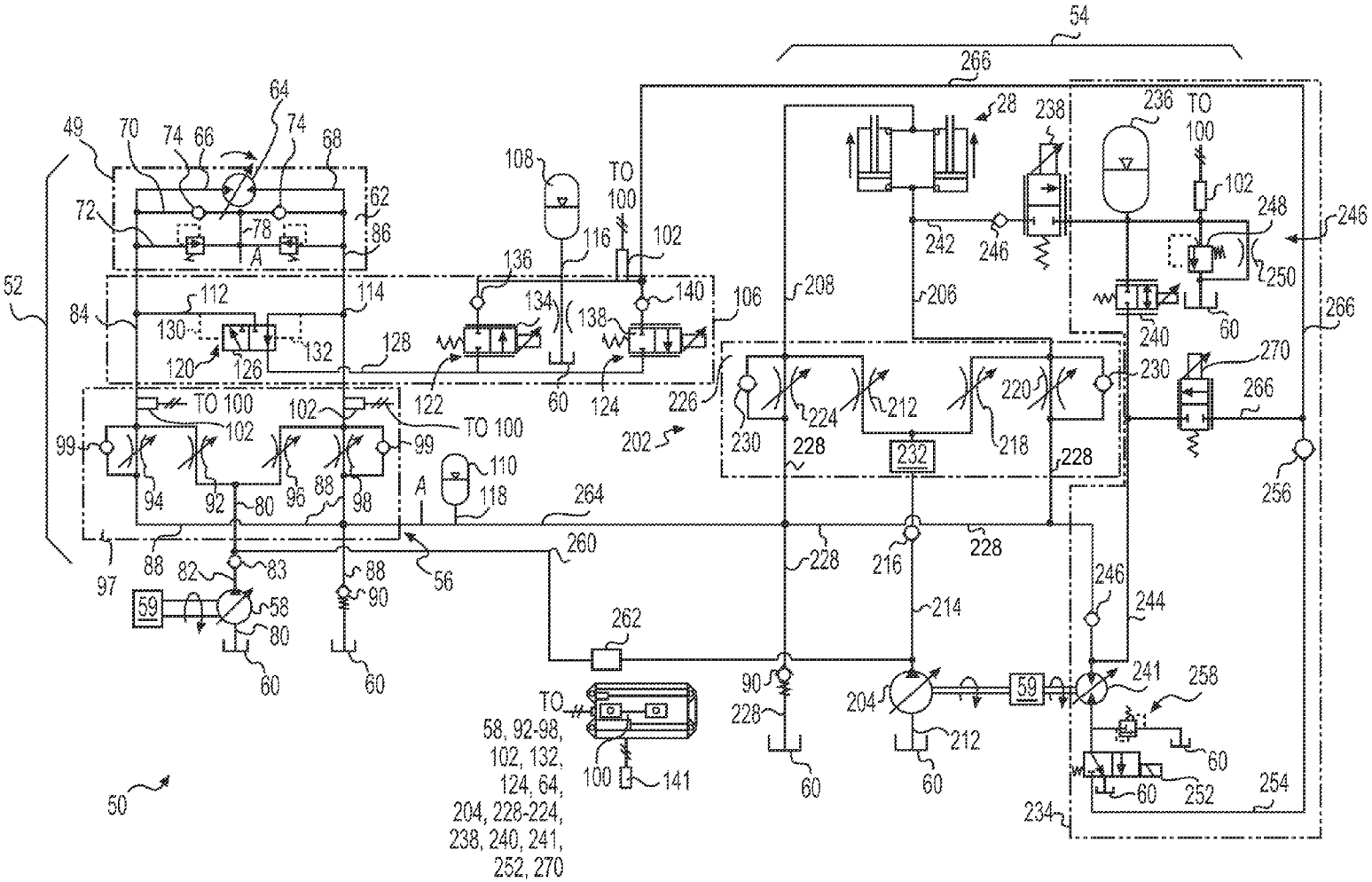
FIGS. 2-4 are schematic illustrations of exemplary disclosed energy recovery systems that may be used with the machine of FIG. 1.

As illustrated in FIG. 2, machine 10 may include an energy recovery system 50 having a plurality of fluid components that cooperate to move implement system 14 (referring to FIG. 1). In particular, energy recovery system 50 may include a swing circuit 52 associated with swing motor 49, a boom circuit 54 associated with hydraulic cylinders 28, and at least one other circuit (not shown) associated with hydraulic cylinders 36 and 38.

Swing circuit 52 may include, among other things, a swing control valve 56 connected to regulate a flow of pressurized fluid from a pump 58 to swing motor 49 and from swing motor 49 to a low-pressure tank 60. This fluid regulation may function to cause a swinging movement of work tool 16 about axis 46 (referring to FIG. 1) in accordance with an operator request received via input device 48.

Swing motor 49 may include a housing 62 at least partially forming a first and a second chamber (not shown) located to either side of an impeller 64. When the first chamber is connected to an output of pump 58 (e.g., via a first chamber passage 66 formed within housing 62) and the second chamber is connected to tank 60 (e.g., via a second chamber passage 68 formed within housing 62), impeller 64 may be driven to rotate in a first direction (shown in FIG. 2). Conversely, when the first chamber is connected to tank 60 via first chamber passage 66 and the second chamber is connected to pump 58 via second chamber passage 68, impeller 64 may be driven to rotate in an opposite direction (not shown). The flow rate of fluid through impeller 64 may relate to a rotational speed of swing motor 49, while a pressure differential across impeller 64 may relate to an output torque thereof.

Swing motor 49 may include built-in makeup and relief functionality. In particular, a makeup passage 70 and a relief passage 72 may be formed within housing 62, between first chamber passage 66 and second chamber passage 68. A pair of opposing check valves 74 and a pair of opposing relief valves 76 may be disposed within makeup and relief passages 70, 72, respectively. A low-pressure passage 78 may be connected to each of makeup and relief passages 70, 72 at locations between check valves 74 and between relief valves 76. Based on a pressure differential between low-pressure passage 78 and first and second chamber passages 66, 68, one of check valves 74 may open to allow fluid from low-pressure passage 78 into the lower-pressure one of the first and second chambers. Similarly, based on a pressure differential between first and second chamber passages 66, 68 and low-pressure passage 78, one of relief valves 76 may open to allow fluid from the higher-pressure one of the first and second chambers into low-pressure passage 78. A significant pressure differential may generally exist between the first and second chambers during a swinging movement of implement system 14.

Pump 58 may be driven by an engine 59 of machine 10 to draw fluid from tank 60 via an inlet passage 80, pressurize the fluid to a desired level, and discharge the fluid into swing circuit 52 via a discharge passage 82. A check valve 83 may be disposed within discharge passage 82, if desired, to provide for a unidirectional flow of pressurized fluid from pump 58 into swing circuit 52. Pump 58 may embody, for example, a variable displacement pump (shown in FIG. 2), a fixed displacement pump, or another source known in the art. Pump 58 may be drivably connected to engine 59 or another power source of machine 10 by, for example, a countershaft (not shown), a belt (not shown), an electrical circuit (not shown), or in another suitable manner. Alternatively, pump 58 may be indirectly connected to engine 59 of machine 10 via a torque converter, a reduction gear box, an electrical circuit, or in any other suitable manner. Pump 58 may produce a stream of pressurized fluid having a pressure level and/or a flow rate determined, at least in part, by demands of the actuator(s) within swing circuit 52 that correspond with operator requested movements. Discharge passage 82 may be connected within swing circuit 52 to first and second chamber passages 66, 68 via swing control valve 56 and first and second chamber conduits 84, 86, respectively, which extend between swing control valve 56 and swing motor 49.

Tank 60 may constitute a reservoir configured to hold a low-pressure supply of fluid. The fluid may include, for example, a dedicated hydraulic oil, an engine lubrication oil, a transmission lubrication oil, or any other fluid known in the art. One or more hydraulic circuits within machine 10 may draw fluid from and return fluid to tank 60. It is contemplated that energy recovery system 50 may be connected to multiple separate fluid tanks (shown in FIG. 2) or to a single tank, as desired. Tank 60 may be fluidly connected to swing control valve 56 via a return passage 88, and to first and second chamber passages 66, 68 via swing control valve 56 and first and second chamber conduits 84, 86, respectively. Tank 60 may also be connected to low-pressure passage 78. One or more check valves 90 may be disposed within return passage 88, if desired, to promote a unidirectional flow of fluid into tank 60 and/or to maintain a desired return flow pressure.

Swing control valve 56 may have elements that are movable to control the rotation of swing motor 49 and corresponding swinging motion of implement system 14. Specifically, swing control valve 56 may include a first chamber supply element 92, a first chamber drain element 94, a second chamber supply element 96, and a second chamber drain element 98 all disposed within a common block or housing 97. The first and second chamber supply elements 92, 96 may be connected in parallel with discharge passage 82 to regulate filling of their respective chambers with fluid from pump 58, while the first and second chamber drain elements 94, 98 may be connected in parallel with return passage 88 to regulate draining of the respective chambers of fluid. A makeup valve 99, for example a check valve, may be disposed between discharge passage 82 and an outlet of first chamber drain element 94 and between discharge passage 82 and an outlet of second chamber drain element 98.

To drive swing motor 49 to rotate in a first direction (shown in FIG. 2), first chamber supply element 92 may be shifted to allow pressurized fluid from pump 58 to enter the first chamber of swing motor 49 via discharge passage 82 and first chamber conduit 84, while second chamber drain element 98 may be shifted to allow fluid from the second chamber of swing motor 49 to drain to tank 60 via second chamber conduit 86 and return passage 88. To drive swing motor 49 to rotate in the opposite direction, second chamber supply element 96 may be shifted to communicate the second chamber of swing motor 49 with pressurized fluid from pump 58, while first chamber drain element 94 may be shifted to allow draining of fluid from the first chamber of swing motor 49 to tank 60. It is contemplated that both the supply and drain functions of swing control valve 56 (i.e., of the four different supply and drain elements) may alternatively be performed by a single valve element associated with the first chamber and a single valve element associated with the second chamber, or by a single valve element associated with both the first and second chambers, if desired.

Supply and drain elements 92-98 of swing control valve 56 may be solenoid-movable against a spring bias in response to a flow rate and/or position command issued by a controller 100. In particular, swing motor 49 may rotate at a velocity that corresponds with the flow rate of fluid into and out of the first and second chambers. Accordingly, to achieve an operator-desired swing speed, a command based on an assumed or measured pressure drop may be sent to the solenoids (not shown) of supply and drain elements 92-98 that causes them to open an amount corresponding to the necessary fluid flow into swing motor 49. This command may be in the form of a flow rate command or a valve element position command that is issued by controller 100.

Swing circuit 52 may be fitted with an energy recovery module (ERM) 104 that is configured to selectively extract and recover energy from waste fluid that is discharged by swing motor 49. ERM 104 may include, among other things, a recovery valve block (RVB) 106 that is fluidly connectable between pump 58 and swing motor 49, a swing accumulator 108 configured to selectively communicate with swing motor 49 via RVB 106, and a makeup accumulator 110 also configured to selectively and directly communicate with swing motor 49. In the disclosed embodiment, RVB 106 may be fixedly and mechanically connectable to one or both of swing control valve 56 and swing motor 49, for example directly to housing 62 and/or directly to housing 97. RVB 106 may include an internal first passage 112 fluidly connectable to first chamber conduit 84, and an internal second passage 114 fluidly connectable to second chamber conduit 86. Swing accumulator 108 may be fluidly connected to RVB 106 via a conduit 116, while makeup accumulator 110 may be fluidly connectable to low-pressure and return passages 78 and 88, in parallel with tank 60, via a conduit 118.

RVB 106 may house a selector valve 120, a charge valve 122 associated with swing accumulator 108, and a discharge valve 124 associated with swing accumulator 108 and disposed in parallel with charge valve 122. Selector valve 120 may automatically fluidly communicate one of first and second passages 112, 114 with charge and discharge valves 122, 124 based on a pressure of first and second passages 112, 114. Charge and discharge valves 122, 124 may be selectively movable in response to commands from controller 100 to fluidly communicate swing accumulator 108 with selector valve 120 for fluid charging or discharging purposes.

Selector valve 120 may be a pilot-operated, 2-position, 3-way valve that is automatically movable in response to fluid pressures in first and second passages 112, 114 (i.e., in response to a fluid pressures within the first and second chambers of swing motor 49). In particular, selector valve 120 may include a valve element 126 that is movable from a first position (shown in FIG. 2) at which first passage 112 is fluidly connected to charge and discharge valves 122, 124 via an internal passage 128, toward a second position (not shown) at which second passage 114 is fluid connected to charge and discharge valves 122, 124 via passage 128. When first passage 112 is fluidly connected to charge and discharge valves 122, 124 via passage 128, fluid flow through second passage 114 may be inhibited by selector valve 120, and vice versa. First and second pilot passages 130, 132 may communicate fluid from first and second passages 112, 114 to opposing ends of valve element 126 such that a higher-pressure one of first or second passages 112, 114 may cause valve element 126 to move and fluidly connect the corresponding passage with charge and discharge valves 122, 124 via passage 128.

Charge valve 122 may be a solenoid-operated, variable position, 2-way valve that is movable in response to a command from controller 100 to allow fluid from passage 128 to enter swing accumulator 108. In particular, charge valve 122 may include a valve element 134 that is movable from a first position (shown in FIG. 2) at which fluid flow from passage 128 into swing accumulator 108 is inhibited, toward a second position (not shown) at which passage 128 is fluidly connected to swing accumulator 108. When valve element 134 is away from the first position (i.e., in the second position or in an intermediate position between the first and second positions) and a fluid pressure within passage 128 exceeds a fluid pressure within swing accumulator 108, fluid from passage 128 may fill (i.e., charge) swing accumulator 108. Valve element 134 may be spring-biased toward the first position and movable in response to a command from controller 100 to any position between the first and second positions to thereby vary a flow rate of fluid from passage 128 into swing accumulator 108. A check valve 136 may be disposed between charge valve 122 and swing accumulator 108 to provide for a unidirectional flow of fluid into accumulator 108 via charge valve 122.

Discharge valve 124 may be substantially identical to charge valve 122 in composition, and selectively movable in response to a command from controller 100 to allow fluid from swing accumulator 108 to enter passage 128 (i.e., to discharge). In particular, discharge valve 124 may include a valve element 138 that is movable from a first position (not shown) at which fluid flow from swing accumulator 108 into passage 128 is inhibited, toward a second position (shown in FIG. 2) at which swing accumulator 108 is fluidly connected to passage 128. When valve element 138 is away from the first position (i.e., in the second position or in an intermediate position between the first and second positions) and a fluid pressure within swing accumulator 108 exceeds a fluid pressure within passage 128, fluid from swing accumulator 108 may flow into passage 128. Valve element 138 may be spring-biased toward the first position and movable in response to a command from controller 100 to any position between the first and second positions to thereby vary a flow rate of fluid from swing accumulator 108 into passage 128. A check valve 140 may be disposed between swing accumulator 108 and discharge valve 124 to provide for a unidirectional flow of fluid from accumulator 108 into passage 128 via discharge valve 124.

An additional pressure sensor 102 may be associated with swing accumulator 108 and configured to generate signals indicative of a pressure of fluid within swing accumulator 108, if desired. In the disclosed embodiment, the additional pressure sensor 102 may be disposed between swing accumulator 108 and discharge valve 124. It is contemplated, however, that the additional pressure sensor 102 may alternatively be disposed between swing accumulator 108 and charge valve 122 or directly connected to swing accumulator 108, if desired. Signals from the additional pressure sensor 102 may be directed to controller 100 for use in regulating operation of charge and/or discharge valves 122, 124.

Swing and makeup accumulators 108, 110 may each embody pressure vessels filled with a compressible gas that are configured to store pressurized fluid for future use by swing motor 49. The compressible gas may include, for example, nitrogen, argon, helium, or another appropriate compressible gas. As fluid in communication with swing and makeup accumulators 108, 110 exceeds pressures of swing and makeup accumulators 108, 110, the fluid may flow into accumulators 108, 110. Because the gas therein is compressible, it may act like a spring and compress as the fluid flows into swing and makeup accumulators 108, 110. When the pressure of the fluid within conduits 116, 118 drops below the pressures of swing and makeup accumulators 108, 110, the compressed gas may expand and urge the fluid from within swing and makeup accumulators 108, 110 to exit. It is contemplated that swing and makeup accumulators 108, 110 may alternatively embody membrane/spring-biased or bladder types of accumulators, if desired.

In the disclosed embodiment, swing accumulator 108 may be a larger (i.e., about 5-20 times larger) and higher-pressure (i.e., about 5-60 times higher-pressure) accumulator, as compared to makeup accumulator 110. Specifically, swing accumulator 108 may be configured to accumulate fluid having a pressure in a range of about 300 bar, while makeup accumulator 110 may be configured to accumulate about 20-25% as much fluid as swing accumulator 108 having a pressure in a range of about 5-30 bar. In this configuration, swing accumulator 108 may be used primarily to assist the motion of swing motor 49 and to improve machine efficiencies, while makeup accumulator 110 may be used primarily as a makeup accumulator to help reduce a likelihood of voiding at swing motor 49. It is contemplated, however, that other volumes and pressures may be accommodated by first and/or makeup accumulators 108, 110, if desired.

Controller 100 may be configured to selectively cause swing accumulator 108 to charge and discharge, thereby improving performance of machine 10. In particular, a typical swinging motion of implement system 14 instituted by swing motor 49 may consist of segments of time during which swing motor 49 is accelerating a swinging movement of implement system 14, and segments of time during which swing motor 49 is decelerating the swinging movement of implement system 14. The acceleration segments may require significant energy from swing motor 49 that is conventionally realized by way of pressurized fluid supplied to swing motor 49 by pump 58, while the deceleration segments may produce significant energy in the form of pressurized fluid that is conventionally wasted through discharge to tank 60. Both the acceleration and the deceleration segments may require swing motor 49 to convert significant amounts of hydraulic energy to swing kinetic energy, and vice versa. The pressurized fluid passing through swing motor 49 during deceleration, however, still contains a large amount of energy. If the fluid passing through swing motor 49 is selectively collected within swing accumulator 108 during the deceleration segments, this energy can then be returned to (i.e., discharged) and reused by swing motor 49 during the ensuing acceleration segments. Swing motor 49 can be assisted during the acceleration segments by selectively causing swing accumulator 108 to discharge pressurized fluid into the higher-pressure chamber of swing motor 49 (via discharge valve 124, passage 128, selector valve 120, and the appropriate one of first and second chamber conduits 84, 86), alone or together with high-pressure fluid from pump 58, thereby propelling swing motor 49 at the same or greater rate with less pump power than otherwise possible via pump 58 alone. Swing motor 49 can be assisted during the deceleration segments by selectively causing swing accumulator 108 to charge with fluid exiting swing motor 49, thereby providing additional resistance to the motion of swing motor 49 and lowering a restriction and associated cooling requirement of the fluid exiting swing motor 49.

In an alternative embodiment, controller 100 may be configured to selectively control charging of swing accumulator 108 with fluid exiting pump 58, as opposed to fluid exiting swing motor 49. That is, during a peak-shaving or economy mode of operation, controller 100 may be configured to cause swing accumulator 108 to charge with fluid exiting pump 58 (e.g., via control valve 56, the appropriate one of first and second chamber conduits 84, 86, selector valve 120, passage 128, and charge valve 122) when pump 58 and engine 59 have excess capacity (i.e., a capacity greater than required by swing circuit 52 to move work tool 16 as requested by the operator). During this charging, it may be necessary to restrict the outlet flow of swing motor 49 to less than the full flow rate of fluid from pump 58, such that the remaining flow may be forced into swing accumulator 108. Then, during times when pump 58 has insufficient capacity to adequately power swing motor 49, the high-pressure fluid previously collected from pump 58 within swing accumulator 108 may be discharged in the manner described above to assist swing motor 49. Such operation may facilitate a size reduction of engine 59, in some applications.

Controller 100 may be configured to regulate the charging and discharging of swing accumulator 108 based on a current or ongoing segment of the excavation, material handling, or other work cycle of machine 10. In particular, based on input received from one or more performance sensors 141, controller 100 may be configured to partition a typical work cycle performed by machine 10 into a plurality of segments, for example, into a dig segment, a swing-to-dump acceleration segment, a swing-to-dump deceleration segment, a dump segment, a swing-to-dig acceleration segment, and a swing-to-dig deceleration segment. Based on the segment of the excavation work cycle currently being performed, controller 100 may selectively cause swing accumulator 108 to charge or discharge, thereby assisting swing motor 49 during the acceleration and deceleration segments.

One or more maps and/or dynamic elements relating signals from sensor(s) 141 to the different segments of the excavation work cycle may be stored within the memory of controller 100. Each of these maps may include a collection of data in the form of tables, graphs, and/or equations. The dynamic elements may include integrators, filters, rate limiters, and delay elements. In one example, threshold speeds, cylinder pressures, and/or operator input (i.e., lever position) associated with the start and/or end of one or more of the segments may be stored within the maps. In another example, threshold forces and/or actuator positions associated with the start and/or end of one or more of the segments may be stored within the maps. Controller 100 may be configured to reference the signals from sensor(s) 141 with the maps and filters stored in memory to determine the segment of the excavation work cycle currently being executed, and then regulate the charging and discharging of swing accumulator 108 accordingly. Controller 100 may allow the operator of machine 10 to directly modify these maps and/or to select specific maps from available relationship maps stored in the memory of controller 100 to affect segment partitioning and accumulator control, as desired. It is contemplated that the maps may additionally or alternatively be automatically selectable based on modes of machine operation, if desired.

Sensor(s) 141 may be associated with the generally horizontal swinging motion of work tool 16 imparted by swing motor 49 (i.e., the motion of frame 42 relative to undercarriage member 44). For example, sensor 141 may embody a rotational position or speed sensor associated with the operation of swing motor 49, an angular position or speed sensor associated with the pivot connection between frame 42 and undercarriage member 44, a local or global coordinate position or speed sensor associated with any linkage member connecting work tool 16 to undercarriage member 44 or with work tool 16 itself, a displacement sensor associated with movement of operator input device 48, or any other type of sensor known in the art that may generate a signal indicative of a swing position, speed, force, or other swing-related parameter of machine 10. The signal generated by sensor(s) 241 may be sent to and recorded by controller 100 during each excavation work cycle. It is contemplated that controller 100 may derive a swing speed based on a position signal from sensor 141 and an elapsed period of time, if desired.

Alternatively or additionally, sensor(s) 141 may be associated with the vertical pivoting motion of work tool 16 imparted by hydraulic cylinders 28 (i.e., associated with the lifting and lowering motions of boom 24 relative to frame 42). Specifically, sensor 141 may be an angular position or speed sensor associated with a pivot joint between boom 24 and frame 42, a displacement sensor associated with hydraulic cylinders 28, a local or global coordinate position or speed sensor associated with any linkage member connecting work tool 16 to frame 42 or with work tool 16 itself, a displacement sensor associated with movement of operator input device 48, or any other type of sensor known in the art that may generate a signal indicative of a pivoting position or speed of boom 24. It is contemplated that controller 100 may derive a pivot speed based on a position signal from sensor 141 and an elapsed period of time, if desired.

In yet an additional embodiment, sensor(s) 141 may be associated with the tilting force of work tool 16 imparted by hydraulic cylinder 38. Specifically, sensor 141 may be a pressure sensor associated with one or more chambers within hydraulic cylinder 38 or any other type of sensor known in the art that may generate a signal indicative of a tilting force of machine 10 generated during a dig and dump operation of work tool 16.

It should be noted that controller 100 may be limited during the charging and discharging of swing accumulator 108 by fluid pressures within first chamber conduit 84, second chamber conduit 86, and swing accumulator 108. That is, even though a particular segment in the work cycle of machine 10 during a particular mode of operation may call for charging or discharging of swing accumulator 108, controller 100 may only be allowed to implement the action when the related pressures have corresponding values. For example, if sensors 102 indicate that a pressure of fluid within swing accumulator 108 is below a pressure of fluid within first chamber conduit 84, controller 100 may not be allowed to initiate discharge of swing accumulator 108 into first chamber conduit 84. Similarly, if sensors 102 indicate that a pressure of fluid within second chamber conduit 86 is less than a pressure of fluid within swing accumulator 108, controller 100 may not be allowed to initiate charging of swing accumulator 108 with fluid from second chamber conduit 86. Not only could the exemplary processes be impossible to implement at particular times when the related pressures are inappropriate, but an attempt to implement the processes could result in undesired machine performance.

During the discharging of pressurized fluid from swing accumulator 108 to swing motor 49, the fluid exiting swing motor 49 may still have an elevated pressure that, if allowed to drain into tank 60, may be wasted. At this time, makeup accumulator 110 may be configured to charge with fluid exiting swing motor 49 any time that swing accumulator 108 is discharging fluid to swing motor 49. In addition, during the charging of swing accumulator 108, it may be possible for swing motor 49 to receive too little fluid from pump 58 and, unless otherwise accounted for, the insufficient supply of fluid from pump 58 to swing motor 49 under these conditions could cause swing motor 49 to cavitate. Accordingly, makeup accumulator 110 may be configured to discharge to swing motor 49 any time that swing accumulator 108 is charging with fluid from swing motor 49.

As described above, makeup accumulator 110 may discharge fluid any time a pressure within low-pressure passage 78 falls below the pressure of fluid within makeup accumulator 110. Accordingly, the discharge of fluid from makeup accumulator 110 into swing circuit 52 may not be directly regulated via controller 100. However, because makeup accumulator 110 may charge with fluid from swing circuit 52 whenever the pressure within return passage 88 exceeds the pressure of fluid within makeup accumulator 110, and because control valve 56 may affect the pressure within return passage 88, controller 100 may have some control over the charging of makeup accumulator 110 with fluid from swing circuit 52 via control valve 56.

In some situations, it may be possible for both swing and makeup accumulators 108, 110 to simultaneously charge with pressurized fluid. These situations may correspond, for example, with operation in the peak-shaving modes. In particular, it may be possible for makeup accumulator 110 to simultaneously charge with pressurized fluid when pump 58 is providing pressurized fluid to both swing motor 49 and to swing accumulator 108. At these times, the fluid exiting pump 58 may be directed into swing accumulator 108, while the fluid exiting swing motor 49 may be directed into makeup accumulator 110.

Makeup accumulator 110 may also be charged via boom circuit 54, if desired. In particular, any time waste fluid from boom circuit 54 (i.e., fluid draining from boom circuit 54 to tank 60) has a pressure greater than the threshold pressure of makeup accumulator 110, the waste fluid may be collected within makeup accumulator 110. In a similar manner, pressurized fluid within makeup accumulator 110 may be selectively discharged into boom circuit 54 when the pressure within boom circuit 54 falls below the pressure of fluid collected within makeup accumulator 110. The connection between makeup accumulator 110 and boom circuit 54 will be described in more detail below.

Controller 100 may be in communication with the different components of swing circuit 52 to regulate operations of machine 10. For example, controller 100 may be in communication with the elements of swing control valve 56 in swing circuit 52. Based on various operator input and monitored parameters, as will be described in more detail below, controller 100 may be configured to selectively activate control valves 56 in a coordinated manner to efficiently carry out operator requested movements of implement system 14.

Controller 100 may include a memory, a secondary storage device, a clock, and one or more processors that cooperate to accomplish a task consistent with the present disclosure. Numerous commercially available microprocessors can be configured to perform the functions of controller 100. It should be appreciated that controller 100 could readily embody a general machine controller capable of controlling numerous other functions of machine 10. Various known circuits may be associated with controller 100, including signal-conditioning circuitry, communication circuitry, and other appropriate circuitry. It should also be appreciated that controller 100 may include one or more of an application-specific integrated circuit (ASIC), a field-programmable gate array (FPGA), a computer system, and a logic circuit configured to allow controller 100 to function in accordance with the present disclosure.

The operational parameters monitored by controller 100, in one embodiment, may include a pressure of fluid within swing and/or boom circuits 52, 54. For example, one or more pressure sensors 102 may be strategically located within first chamber and/or second chamber conduits 84, 86 to sense a pressure of the respective passages and generate a corresponding signal indicative of the pressure directed to controller 100. It is contemplated that any number of pressure sensors 102 may be placed in any location within swing and/or boom circuits 52, 54, as desired. It is further contemplated that other operational parameters such as, for example, speeds, temperatures, viscosities, densities, etc. may also or alternatively be monitored and used to regulate operation of energy recovery system 50, if desired.

Boom circuit 54 may include, among other things, a boom control valve 202 modulated by controller 100 to regulate a flow of pressurized fluid from a pump 204 to hydraulic cylinders 28 and from hydraulic cylinders 28 to tank 60. This fluid regulation may function to cause a lifting or lowering movement of work tool 16 about the associated horizontal axis (referring to FIG. 1) in accordance with an operator request received via input device 48.

Hydraulic cylinders 28 may each embody a linear actuator having a tubular housing and a piston assembly arranged to form two separated pressure chambers (e.g., a head chamber and a rod chamber) within the housing. The pressure chambers may be selectively supplied with pressurized fluid and drained of the pressurized fluid to cause the piston assembly to displace within the tubular housing, thereby changing an effective length of hydraulic cylinders 28. The flow rate of fluid into and out of the pressure chambers may relate to a velocity of hydraulic cylinders 28, while a pressure differential between the two pressure chambers may relate to a force imparted by hydraulic cylinders 28 on the associated linkage members. The expansion and retraction of hydraulic cylinders 28 may function to lift and lower work tool 16 relative to work surface 26.

Boom control valve 202 may be connected to hydraulic cylinders 28 by way of a head-end passage 206 and a rod-end passage 208. Based on an operating position of boom control valve 202, one of head- and rod-end passages 206, 208 may be connected to pump 204 via boom control valve 202, while the other of head- and rod-end passages 206, 208 may be simultaneously connected to tank 60 via boom control valve 202, thereby creating the pressure differential across the piston assembly within hydraulic cylinders 28 that causes extension or retraction thereof. A significant pressure differential may generally exist between the head and rod chambers during a lifting or lower movement of work tool 16, particularly during a lowering movement when work tool 16 is heavily loaded. That is, during the lowering movement, rod-end passage 208 may carry fluid having a much higher pressure than fluid carried within head-end passage 206 at that same time.

Pump 204, in the disclosed exemplary embodiment, may be substantially identical to pump 58 of swing circuit 52. In particular, pump 204 may be driven by engine 59 to draw fluid from tank 60 via an inlet passage 212, pressurize the fluid to a desired level, and discharge the fluid into boom circuit 54 via a discharge passage 214. A check valve 216 may be disposed within discharge passage 214, if desired, to provide for a unidirectional flow of pressurized fluid from pump 204 into boom circuit 54. Pump 204 may embody, for example, a variable displacement pump (shown in FIG. 2), a fixed displacement pump, or another source known in the art. Pump 204 may be drivably connected to engine 59 of machine 10 by, for example, a countershaft (not shown), a belt (not shown), an electrical circuit (not shown), or in another suitable manner. Alternatively, pump 204 may be indirectly connected to engine 59 of machine 10 via a torque converter, a reduction gear box, an electrical circuit, or in any other suitable manner. Pump 204 may produce a stream of pressurized fluid having a pressure level and/or a flow rate determined, at least in part, by demands of the actuators within boom circuit 54 that correspond with operator requested movements. Discharge passage 214 may be connected within boom circuit 54 to head- and rod-end passages 206, 208 via boom control valve 202.

Boom control valve 202, in the disclosed exemplary embodiment, may be substantially identical to swing control valve 56. In particular, boom control valve 202 may have elements that are movable to control the extension and retraction of hydraulic cylinders 28 and corresponding lifting and lowering motions of implement system 14. Specifically, boom control valve 202 may include a head-end supply element 218, a head-end drain element 220, a rod-end supply element 222, and a rod-end drain element 224 all disposed within a common block or housing 226. Head- and rod-end supply elements 218, 222 may be connected in parallel with discharge passage 214 to regulate filling of their respective chambers with fluid from pump 204, while head- and rod-end drain elements 220, 224 may be connected in parallel with a return passage 228 to regulate draining of the respective chambers of fluid to tank 60. A makeup valve 230, for example a check valve, may be disposed between return passage 228 and an outlet of head-end drain element 220 and between return passage 228 and an outlet of rod-end drain element 224.

To extend hydraulic cylinders 28 (shown in FIG. 2), head-end supply element 218 may be shifted to allow pressurized fluid from pump 204 to enter the head chamber of hydraulic cylinders 28 via discharge passage 214 and head-end conduit 206, while rod-end drain element 224 may be shifted to allow fluid from the rod chamber to drain into tank 60 via rod-end conduit 208 and return passage 228. To retract hydraulic cylinders 28, rod-end supply element 222 may be shifted to communicate the rod chamber with pressurized fluid from pump 204, while head-end drain element 220 may be shifted to allow draining of fluid from the head chamber into tank 60. It is contemplated that both the supply and drain functions of boom control valve 202 (i.e., of the four different supply and drain elements) may alternatively be performed by a single valve element associated with the head chamber and a single valve element associated with the rod chamber, or by a single valve element associated with both the head and rod chambers, if desired.

Supply and drain elements 218-224 of boom control valve 202 may be solenoid-movable against a spring bias in response to a flow rate and/or position command issued by a controller 100. In particular, hydraulic cylinders 28 may extend and retract at velocities that correspond with the flow rates of fluid into and out of the head and rod chambers. Accordingly, to achieve an operator-desired lift speed, a command based on an assumed or measured pressure drop may be sent to the solenoids (not shown) of supply and drain elements 218-224 that causes them to open an amount corresponding to the necessary fluid flow rates at hydraulic cylinders 28. This command may be in the form of a flow rate command or a valve element position command that is issued by controller 100.

In some embodiments, a pressure compensator 232 may be included within boom circuit 54 and associated with boom control valve 202. In the disclosed example, pressure compensator 232 is disposed within discharge passage 214 at a location upstream of boom control valve 202. In this location, pressure compensator 232 may be configured to supply a substantially constant flow rate of fluid to boom control valve 202 during fluctuations in supply pressure caused by interaction of boom circuit 54 with swing circuit 52.

Like swing circuit 52, boom circuit 54 may also be fitted with an energy recovery module (ERM) 234 that is configured to selectively extract and recover energy from waste fluid that is discharged by hydraulic cylinders 28. ERM 234 may include, among other things, a boom accumulator 236 configured to selectively communicate with hydraulic cylinders 28 via a first charge valve 238 and a second charge valve 240, and a motor 241 selectively driven by the accumulated fluid. A passage 242 may extend from head-end passage 206 through charge valve 238 to boom accumulator 236, and a passage 244 may extend from return passage 228 through charge valve 240 to boom accumulator 236. One or more check valves 246 may be disposed within each of passages 242 and 244 to promote unidirectional fluid flows into boom accumulator 236. First and second charge valves 238, 240 may be selectively movable in response to commands from controller 100 to fluidly communicate head-end passage 206 and/or return passage 228 with boom accumulator 236 for fluid charging purposes.

Boom accumulator 236 of boom circuit 54 may be similar to swing and makeup accumulators 108, 110 of swing circuit 52. In particular, boom accumulator 236 may embody a pressure vessel filled with a compressible gas that is configured to store pressurized fluid for future use by hydraulic cylinders 28. The compressible gas may include, for example, nitrogen, argon, helium, or another appropriate compressible gas. As fluid in communication with boom accumulator 236 exceeds a pressure of boom accumulator 236, the fluid may flow into boom accumulator 236. Because the gas therein is compressible, it may act like a spring and compress as the fluid flows into boom accumulator 236. When the pressure of the fluid within passage 244 drops below the pressure of boom accumulator 236, the compressed gas may expand and urge the fluid from within boom accumulator 236 to exit. It is contemplated that boom accumulator 236 may alternatively embody a membrane/spring-biased or bladder type of accumulator, if desired.

In the disclosed embodiment, boom accumulator 236 may be about the same size as swing accumulator 108, but configured to hold fluid at a lower pressure. Specifically, boom accumulator 236 may have a volume of about 50-100 L, and be configured to accommodate pressures of about 80-150 bar. It is contemplated, however, that other volumes and pressures may be accommodated by boom accumulator 236, if desired.

Each of first and second charge valves 238, 240 may be a solenoid-operated, variable position, 2-way valve that is movable in response to a command from controller 100 to allow fluid enter boom accumulator 236 from the respective passages. In particular, each charge valve 238, 240 may include a valve element that is movable from a first position (shown in FIG. 2) at which fluid flow into boom accumulator 236 is inhibited, toward a second position (not shown) at which fluid may freely enter boom accumulator 236 substantially unrestricted by the valve element. When the valve element is away from the first position (i.e., in the second position or in an intermediate position between the first and second positions) and a fluid pressure in the respective passages exceeds a fluid pressure within boom accumulator 236, the fluid may move into and fill (i.e., charge) boom accumulator 236. The valve element may be spring-biased toward the first position and movable in response to a command from controller 100 to any position between the first and second positions to thereby vary a flow rate of fluid into boom accumulator 236.

In some embodiments, a pressure relief arrangement 246 may be associated with boom accumulator 236. Pressure relief arrangement 246 may include a pressure relief valve 248 disposed in parallel with a restriction 250, both located between boom accumulator 236 and tank 60. Pressure relief valve 248 may be normally closed, but selectively moved to a flow-passing position to relieve fluid pressures within boom accumulator 236. Restriction 250 may be configured to continuously leak some fluid from boom accumulator 236 to tank 60. An additional pressure sensor 102 may be associated with boom accumulator 236, at a location between boom accumulator 236 and pressure relief arrangement 246 to generate corresponding pressure signals directed to controller 100.

Motor 241 may function to convert energy stored in the form of pressurized fluid in boom accumulator 236 to mechanical energy. Specifically, motor 241 may be fluidly connected in parallel to both return passage 228 (downstream of check valve 246) and to boom accumulator 236 via passage 244 and charge valve 240. In this configuration, fluid from either passage may be directed through motor 241 and thereby used to drive motor 241.

Motor 241, in the depicted example, is a variable displacement hydraulic motor that is mechanically coupled to engine 59 and to boom pump 204. By way of this coupling, motor 241, when driven by pressurized fluid, may mechanically assist engine 59 and/or boom pump 204. Motor 241 may assist pump 204 and engine 59 when pump 204 has a positive displacement or, alternatively assist only engine 59 when pump 204 has a neutral displacement. In addition, in some embodiments, engine 59 may selectively drive motor 241 to increase a pressure of the fluid directed through motor 241.

A motor control valve 252 may be associated with an outlet of motor 241 and used to regulate the operation of motor 241. In particular, motor control valve 252 may be configured to direct the fluid exiting motor 241 into tank 60 or into a return passage 254 and through a check valve 256. When the fluid exiting motor 241 is directed into tank 60, a maximum pressure differential across motor 241 may be created, which serves to convert a maximum amount of fluid energy to mechanical energy. When the exiting fluid is directed into return passage 254, it may be reused for other purposes. In some situations, the returning fluid (i.e., the fluid in return passage 254) may have had some energy removed from it and, hence be at a lower pressure than when it entered motor 241.

In other situations, however, the returning fluid may have had some energy added to it and, hence, be at a higher pressure than when it entered motor 241. A pressure relief valve 258 may be associated with the outlet of motor 241, if desired, to protect system components during operation in the latter situation. Use of the return fluid will be described in more detail below.

Swing and boom circuits 52, 54 may be interconnected for flow sharing and energy recuperation purposes. For example, a common supply passage 260 may extend between swing and boom circuits 52, 54 to connect discharge passages 82 and 214, and a combiner valve 262 may be disposed within common supply passage 260. Combiner valve 262 may take any conventional form known in the art and be selectively moved by controller 100 to combine the outputs of both pumps 58 and 204 to provide supply fluid for only swing circuit 52, for only boom circuit 54, or both swing and boom circuits 52, 54. A common return passage 264 may also extend between swing and boom circuits 52, 54. Common return passage 264 may connect return passage 88 from swing circuit 52 with return passage 228 from boom circuit 54. In this manner, makeup accumulator 110 may be filled with fluid from both circuits 52, 54 and, likewise, makeup accumulator 110 may provide fluid to both circuits 52, 54 and to motor 241 via check valve 246. Finally, a common accumulator passage 266 may extend from swing accumulator 108 of swing circuit 52 to connect with passage 244 of boom circuit 54. With this configuration, pressurized fluid from swing accumulator 108 may be passed to boom accumulator 236 via common accumulator passage 266, passage 244, and second charge valve 240, and vice versa. Likewise, pressurized fluid from swing accumulator 108 may be passed through and converted to mechanical energy by motor 241 via common accumulator passage 266 and passage 244.

Return passage 254 may connect with common accumulator passage 266 to direct high-pressure fluid exiting motor 241 into swing circuit 52 (e.g., into swing accumulator 108) and/or into boom circuit 54 (e.g., into boom accumulator 236). A control valve 270 disposed within common accumulator passage 266, between the junction with return passage 254 and the junction with passage 244, may be movable to direct the return fluid into the desired circuit(s). In particular, when control valve 270 is in a flow-blocking position (shown in FIG. 2), the return fluid may be forced into only swing circuit 52. And when control valve 270 is in a flow-passing position, the return fluid may be forced into both circuits 52, 54, depending on the pressures of the respective circuits. Likewise, control valve 270 may regulate fluid flow from swing accumulator 108 into boom accumulator 236 (e.g., through passage 244 and second charge valve 240) and through motor 241. Control valve 270 may be an on/off type of valve, movable from a discrete flow-blocking position to a discrete flow-passing position in response to a command from controller 100 to selectively allow fluid from swing accumulator 108 into passage 244. Control valve 270 may be spring-biased toward the flow-blocking position.

Controller 100 may be configured to selectively cause boom accumulator 108 to charge and discharge, thereby improving performance of machine 10. In particular, a motion of implement system 14 instituted by hydraulic cylinders 28 may consist of segments of time during which hydraulic cylinders 28 are lifting implement system 14, and segments of time during which hydraulic cylinders are lowering implement system 14. The lifting segments may require significant energy from hydraulic cylinders 28 that is conventionally realized by way of pressurized fluid supplied to hydraulic cylinders 28 by pump 204, while the lowering segments may produce significant energy in the form of pressurized fluid that is conventionally wasted through discharge to tank 60. Both the lifting and lowering segments may require hydraulic cylinders 28 to convert significant amounts of hydraulic energy to kinetic energy, and vice versa. The pressurized fluid passing through hydraulic cylinders 28 during lowering, however, still contains a large amount of energy. If the fluid discharged from hydraulic cylinders 28 is selectively collected within boom accumulator 236 during the lowering segments, this energy can then be returned to (i.e., discharged) and reused by hydraulic cylinders 28 during the ensuing lifting segments. Pump 204 (and engine 59) can be assisted during the lifting segments by selectively causing boom accumulator 236 to discharge pressurized fluid through motor 241 (via second charge valve 240 and passage 244), thereby driving pump 204 at the same or greater rate with less engine power than otherwise possible.

In an alternative embodiment, controller 100 may be configured to additionally or alternatively direct the fluid discharged from boom accumulator 236 during lowering of implement system 14 (or at any other time) into swing circuit 52 (e.g., into swing accumulator 108) to assist movements of swing motor 49. Likewise, controller 100 may be configured to additionally or alternatively direct fluid discharged from swing accumulator 108 into boom accumulator 236 and/or through motor 241. Similarly, controller 100 may additionally or alternatively direct fluid discharged from motor 241 into one or both of swing and boom accumulators 108, 236.

Controller 100 may also be configured to implement a version of peak shaving in association with boom circuit 54. For example, controller 100 may be configured to cause boom accumulator 236 to charge with fluid exiting pump 204 (e.g., via control valve 202, head-end passage 206, passage 242, check valve 246, and first charge valve 238) when pump 204 and engine 59 have excess capacity (i.e., a capacity greater than required by boom circuit 54 to move work tool 16 as requested by the operator) during a lifting mode of operation. During this charging, it may be necessary to restrict the outlet flow of hydraulic cylinders 28 to less than the full flow rate of fluid from pump 204, such that the remaining flow may be forced into boom accumulator 236. Then, during times when pump 204 and/or engine 59 have insufficient capacity to adequately power hydraulic cylinders 28, the high-pressure fluid previously collected from pump 204 within boom accumulator 236 may be discharged through motor 241 in the manner described above to assist engine 59 and pump 204.

Controller 100 my further be configured to implement peak shaving in connection with both of swing and boom circuits 52, 54. In particular, excess fluid from pump 58 pump 204 may be directed, by way of common accumulator passage 244 between circuits and stored within either of swing or boom accumulators 108, 236.

Figure 3:
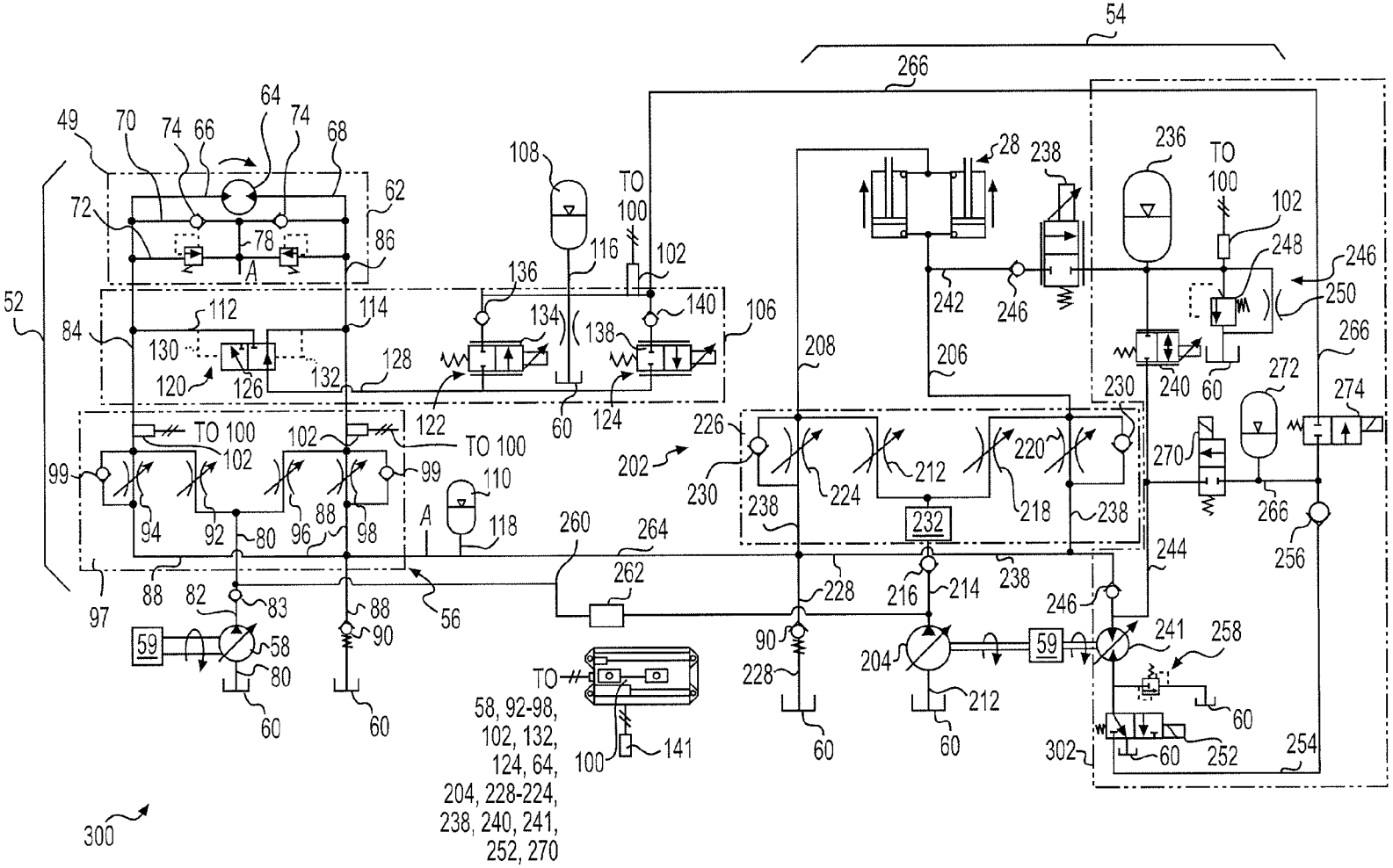

An alternative energy recovery system 300 is illustrated in FIG. 3. Like energy recovery system 50 of FIG. 2, energy recovery system 300 of FIG. 3 may include swing circuit 52 fluidly connected to boom circuit 54 via common supply passage 260, common return passage 264, and common accumulator passage 266. In addition, swing circuit 52 of FIG. 3 may include the same ERM 106, and boom circuit 54 may include a different ERM 302. In contrast to ERM 234 of FIG. 2, ERM 302 of FIG. 3 may include an additional peak shaving accumulator 272 disposed within common accumulator passage 266, at a location between control valve 270 and swing accumulator 108. Further, an additional control valve 274 may be disposed within common accumulator passage 266 between peak shaving accumulator 272 and swing accumulator 108.

Peak shaving accumulator 272 may be substantially similar to swing, makeup, and boom accumulators 108, 110, 236. In particular, peak shaving accumulator 272 may embody a pressure vessel filled with a compressible gas that is configured to store pressurized fluid for future use by either of swing and boom circuits 52, 54. The compressible gas may include, for example, nitrogen, argon, helium, or another appropriate compressible gas. As fluid in communication with peak shaving accumulator 272 exceeds a pressure of peak shaving accumulator 272, the fluid may flow into peak shaving accumulator 272. Because the gas therein is compressible, it may act like a spring and compress as the fluid flows into peak shaving accumulator 272. When the pressure of the fluid within common accumulator passage 266 drops below the pressure of peak shaving accumulator 266, the compressed gas may expand and urge the fluid from within peak shaving accumulator 272 to exit. It is contemplated that peak shaving accumulator 272 may alternatively embody a membrane/spring-biased or bladder type of accumulator, if desired.

Peak shaving accumulator 272 may have a volume that is smaller than the volumes of swing and boom accumulators 108, 236, and a pressure that is in-between the pressures of swing and boom accumulators 108, 236. For example, peak shaving accumulator 272 may have a volume about half the volume of swing accumulator 108, and a pre-charge pressure capacity of less than about 200 bar.

Control valve 274 may be substantially identical to control valve 270. In particular, control valve 274 may be a solenoid-operated, 2-position (flow-blocking and flow-passing), 2-way valve that is movable in response to a command from controller 100 to selectively allow fluid flow through common accumulator passage 270. Control valve 274 may be spring biased to the flow-blocking position.

The location of peak shaving accumulator 272 between control valves 270 and 274 may enhance control over peak shaving operations. For example, during a first operation, control valve 270 may be in its flow-blocking position while control valve 274 may be in its flow-passing position. In this configuration, fluid from only swing accumulator 108 may be directed through common accumulator passage 266 and into peak shaving accumulator 272. During a second operation, both of control valves 270 and 274 may be in their flow-blocking positions. In this configuration, fluid from only motor 241 may be directed into peak shaving accumulator 274. During a third operation, control valve 270 may be in its flow-passing position, while control valve 274 may be in its flow-blocking position. In this configuration, fluid from either or both of boom accumulator 236 and motor 241 may be directed into peak shaving accumulator 272. In similar manner, the fluid stored within peak shaving accumulator 272 may be selectively discharged into swing accumulator 108, boom accumulator 236, and/or into motor 241 by closing different combinations of control valves 270, 274.

Figure 4:
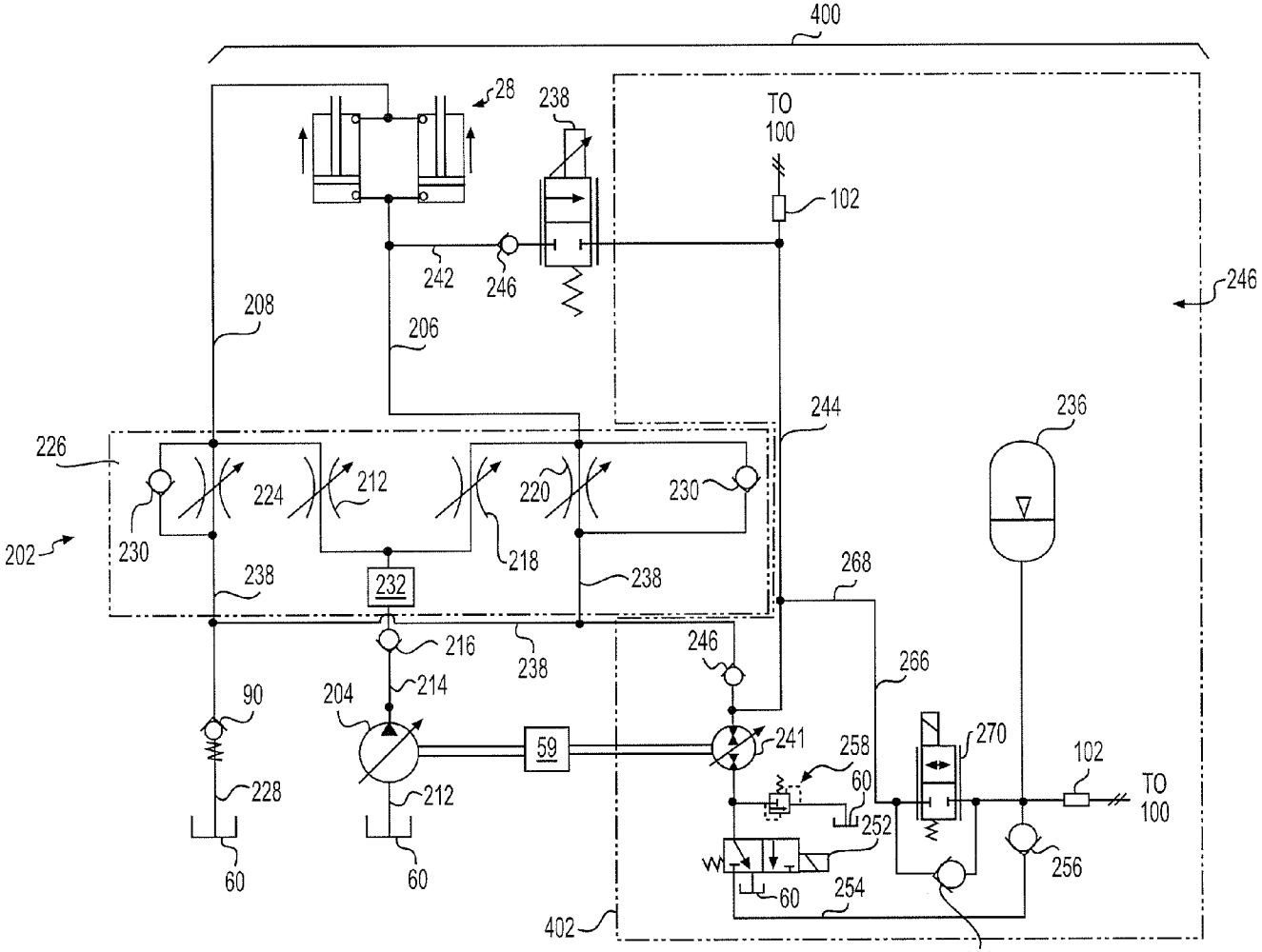

FIG. 4 illustrates an alternative boom circuit 400 that may be used within any hydraulic control system with or without swing circuit 52. Like boom circuits 54 of the previously described embodiments, boom circuit 400 may include tank 60, pump 204 that draws fluid from tank 60, and boom control valve 202 that selectively regulates fluid flow between tank 60, pump 204, and hydraulic cylinders 28. In contrast to the previous embodiments, however, boom circuit 400 of FIG. 4 may include a different ERM 402.

ERM 402, like ERM 234 may include boom accumulator 236, first charge valve 236, motor 241, control valve 252, and control valve 270. However, in contrast to ERM 234, ERM 402 of FIG. 4 may have boom accumulator 236 disposed in a different location. In particular, boom accumulator 236 may be fluidly connected to an output of motor 241, at a location downstream of check valve 256 in return passage 254. In this location, control valve 270 may be located between boom accumulator 236 and passage 244 that extends between head-end passage 206 and motor 241. In addition, ERM 402 may include a unidirectional bypass 404 that extends from boom accumulator 236 around control valve 270 toward passage 244.

The configuration of FIG. 4 may facilitate peak-shaving operations regardless of the interaction of boom circuit 54 with other circuits of machine 10. In particular, based on the position of control valve 252, boom accumulator 236 of ERM 402 may be selectively charged with high-pressure fluid from motor 241 at any time that the pressure exiting motor 241 is higher than a pressure of fluid within boom accumulator 236. This fluid passing through motor 131 and into boom accumulator 236 may be directed from hydraulic cylinders 28 through motor 241 with or without additional energy being added to the fluid. Further, it may be possible to absorb some energy from the cylinder-discharged fluid passing through motor 241 and still have sufficient energy to charge boom accumulator 236. In addition, fluid being discharged from hydraulic cylinders 28 may flow directly into boom accumulator 236 via bypass 404. The fluid stored within boom accumulator 236 may then be selectively directed through control valve 270 and back through motor 241 to impart energy to pump 204 and/or engine 59.

INDUSTRIAL APPLICABILITY

The disclosed energy recovery systems may be applicable to any machine that performs a substantially repetitive work cycle, which involves swinging and/or lifting movements of a work tool. The disclosed energy recovery systems may help to improve machine performance and efficiency by assisting movements of the work tool with accumulators during different segments of the work cycle. In addition, the disclosed energy recovery systems may help to improve machine efficiency by capturing and reusing otherwise wasted energy in a number of different ways.

Several benefits may be associated with the disclosed energy recovery systems. For example, because the disclosed systems may integrate swing and boom circuits during both energy recovery and reuse, a greater amount of energy may be stored and re-used. Further, because the disclosed systems may utilize multiple different accumulators, the accumulators may be relatively small, inexpensive, and easy to package. In addition, the size and/or pressure capacity of each of the accumulators may be tailored to provide enhanced performance to each circuit it is connected to. Finally, by separating the accumulators with different combinations of valves, the associated fluid may be stored, routed, pressure-enhanced, and/or converted in many different ways.

It will be apparent to those skilled in the art that various modifications and variations can be made to the disclosed energy recovery systems. Other embodiments will be apparent to those skilled in the art from consideration of the specification and practice of the disclosed energy recovery systems. It is intended that the specification and examples be considered as exemplary only, with a true scope being indicated by the following claims and their equivalents.

What is claimed is:

1. An energy recovery system, comprising:

a boom circuit having:

at least a one linear actuator configured to move a work tool; and a boom accumulator configured to selectively collect pressurized fluid from the at least one linear actuator;

a swing circuit having:

a swing motor configured to move the work tool; and a swing accumulator configured to selectively collect pressurized fluid from the swing motor and discharge pressurized fluid back to the swing motor;

a common accumulator passage fluidly connecting the boom accumulator and the swing accumulator; and a common accumulator disposed in fluid communication with the common accumulator passage.

2. The energy recovery system of claim 1, wherein:

the boom circuit further has:

a tank;

a first pump configured to draw fluid from the tank and pressurize the fluid; and at least a first control valve movable to selectively direct pressurized fluid from the first pump to the at least one linear actuator and from the at least one linear actuator to the tank; and the energy recovery system further includes a motor selectively driven by fluid discharged from the boom accumulator and the swing accumulator to power the first pump.

3. The energy recovery system of claim 2, wherein the first pump is engine driven, and the motor is further configured to selectively power an engine that drives the first pump.

4. The energy recovery system of claim 2, wherein:

the swing circuit further has:

a second pump configured to draw fluid from the tank and pressurize the fluid; and at least a second control valve movable to selectively direct pressurized fluid from the second pump to the swing motor and from the swing motor to the tank; and the motor is configured to power only the first pump.

5. The energy recovery system of claim 4, further including a control valve disposed within the common accumulator passage and selectively movable from a flow-blocking position against a spring bias toward a flow-passing position.

6. The energy recovery system of claim 5, wherein:

the boom accumulator and motor are connected to the common accumulator passage to receive fluid from the swing accumulator in parallel;

the control valve is a first control valve disposed between the swing accumulator and both of the boom accumulator and the motor; and the energy recovery system further includes a second control valve disposed between the boom accumulator and both of the motor and the first control valve, the second control valve being movable from a flow-blocking position against a spring bias toward a flow-passing position.

7. The energy recovery system of claim 4, further including:

a common low-pressure passage connecting the at least a first control valve with the at least a second control valve and a makeup valve of the motor; and a makeup accumulator fluidly connected to the common low-pressure passage.

8. The energy recovery system of claim 7, further including a pressure relief valve selectively fluidly connecting the common low-pressure passage with the tank.

9. The energy recovery system of claim 7, wherein the common low-pressure passage is further connected to a makeup valve of the swing motor.

10. The energy recovery system of claim 7, further including:

a common high-pressure passage fluidly connecting an output of the first pump with an outlet of the second pump; and a combiner valve disposed within the common high-pressure passage.

11. The energy recovery system of claim 10, further including a pressure compensator disposed downstream of the common high-pressure passage and the first pump, and upstream of the at least a first control valve.

12. The energy recovery system of claim 4, further including:

a return passage extending from an outlet of the motor to the common accumulator passage; and an outlet control valve disposed within the return passage and movable from a first position at which the outlet of the motor is fluidly connected to the tank, against a spring bias toward a second position at which the outlet of the motor is fluidly connected to the common accumulator passage.

13. The energy recovery system of claim 12, further including a pressure relief valve associated with the outlet of the motor.

14. The energy recovery system of claim 1, further including:

a first control valve disposed between the swing accumulator and the common accumulator; and a second control valve disposed between the boom accumulator and the common accumulator.

15. A method of recovering energy, comprising:

directing pressurized fluid into a linear actuator to move a work tool;

storing pressurized fluid from the linear actuator in a boom accumulator;

directing pressurized fluid into a swing motor to move the work tool;

storing pressurized fluid from the linear actuator in a swing accumulator; and selectively communicating the boom and swing accumulators via a common accumulator disposed in fluid communication with a common accumulator passage fluidly connecting the boom and swing accumulators.

16. The method of claim 15, further including selectively directing stored pressurized fluid from the boom and swing accumulators through a motor to drive a boom pump.

17. The method of claim 16, further including selectively directing stored pressurized fluid from the boom and swing accumulators through a motor to drive an engine.

18. The method of claim 17, wherein directing stored pressurized fluid from the swing accumulator through the motor includes directing stored pressurized fluid from the swing accumulator into a common accumulator and from the common accumulator through the motor.

19. A machine, comprising:

an undercarriage;

a boom pivotally connected to the undercarriage;

a work tool operatively connected to the boom;

a swing motor configured to swing the boom and work tool;

a pair of linear actuators configured to lift the boom and work tool;

a boom accumulator configured to selectively collect pressurized fluid from the pair of linear actuators;

a swing accumulator configured to selectively collect pressurized fluid from the swing motor and discharge pressurized fluid back to the swing motor;

a common accumulator passage fluidly connecting the boom accumulator and the swing accumulator;

a common accumulator disposed in fluid communication with the common accumulator passage;

a tank;

a pump configured to draw fluid from the tank and pressurize the fluid;

at least a first control valve movable to selectively direct pressurized fluid from the pump to the pair of linear actuators and from the pair of linear actuators to the tank;

a motor selectively driven by fluid discharged from the boom accumulator and the swing accumulator to power the pump; and a return passage extending from an outlet of the motor to the common accumulator passage.

* * * * *